United States Patent [19]

Wikkerink et al.

[11] 4,286,411

[45] Sep. 1, 1981

[54] MANUAL BALANCED DOOR WITH DOOR CLOSER ARM

[75] Inventors: Lee Wikkerink, Greendale; James R. Schinschke, Milwaukee, both of Wis.

[73] Assignee: Wikk Industries, Inc., Greendale, Wis.

[21] Appl. No.: 73,019

[22] Filed: Sep. 6, 1979

[51] Int. Cl.[3] ..... E05D 15/30

[52] U.S. Cl. ..... 49/252; 49/253; 49/386; 49/340

[58] Field of Search ..... 49/246, 248, 250, 253, 49/334, 340, 386, 390, 252

[56] References Cited

U.S. PATENT DOCUMENTS

| | | | |
|---|---|---|---|
| 3,425,161 | 2/1969 | Catlett et al. | 49/340 X |
| 3,456,388 | 7/1969 | Hanson et al. | 49/386 X |
| 3,579,909 | 5/1971 | Schacht | 49/253 X |

*Primary Examiner*—Kenneth Downey
*Attorney, Agent, or Firm*—Quarles & Brady

[57] ABSTRACT

A manually-operable balanced door with improved operating characteristics is mounted to pivot around a guide roller so that a hinge side of the door swings inwardly from a door frame while a latching side of the door swings outwardly from the door frame. A door closer within the header is reversed from its position in a prior construction so that a rotatable closer shaft extends downwardly from a hinge side portion of the door frame header. The check shaft is coupled by a rigid closer arm to the latching side of the door, while the hinge side of the door is supported between upper and lower door pivot arms. A bearing assembly is disposed within a hinge end of the upper pivot arm and encircles a pivot pin that is supported within a cavity in a side jamb, the pivot pin being easily removable for disassembling the door from the door frame.

11 Claims, 7 Drawing Figures

MANUAL BALANCED DOOR WITH DOOR CLOSER ARM

BACKGROUND OF THE INVENTION

1. Field of the Invention

The field of the invention is balanced doors of the type wherein a door is mounted to pivot around a medially disposed guide roller so that a hinge side portion of the door swings inwardly from the door frame while a latching side portion of the door swings outwardly from the door frame.

2. Description of the Prior Art

A manually operable balanced door is disclosed in Catlett et al, U.S. Pat. No. 3,605,399, issued Sept. 20, 1971. The operability, reliability and maintainability of this balanced door can be improved if the hardware for mounting a door within a door frame is reconfigured in several important respects.

In the prior construction the balanced door is mounted in a doorway by an upper door pivot arm and a lower door pivot arm that are coupled to a hinge side portion of the door to form a vertical pivot axis for the door. A guide track is mounted on a downwardly facing side of a header and a cylindrical guide roller is mounted on a top leaf of the door and is received in the guide track to form a pivot that moves within the door frame. A door closer is disposed within the header so that a pivotable check shaft on the closer is disposed on the latching side of the door frame. A linkage mechanism within the header couples the check shaft to the hinge end of the upper door pivot arm so that the closer applies a rotational force to the upper pivot arm at that point.

The prior arrangement has not been entirely satisfactory, because the door closer does not exert enough control on the door in the 70°-90° range of door-opening swing. In addition, the operating forces that must be applied to the hinge end of the upper pivot arm to restrict the opening of the door, or to return the door to its closed position, are greater than desired, due to the lack of leverage available at the hinge end of the upper pivot arm. Thus, an improvement in the arrangement of the door closer and its linkage mechanism has been sought to improve the operation of the door in the 70°-90° range and provide greater durability for the balanced door assembly.

This prior construction also does not allow convenient disassembly of the door from the door frame for maintenance or replacement of door hardware. This can be seen from considering the prior arrangement in the area of the hinge pin at the hinge end of the upper pivot arm. This hinge pin projects upwardly from the hinge end of the upper pivot arm into an annular bearing that is retained in a race mounted in the upper corner of the door frame level with the header. This was necessary in the prior construction because space along the upper hinge pin had to be reserved to couple the door closer linkage. This arrangement was unsatisfactory, however, when the door had to be removed, because the upper hinge pin and bearing assembly were relatively inaccessible in the upper corner of the door frame.

SUMMARY OF THE INVENTION

The invention is incorporated in a new arrangement of hardware for mounting a door within a door frame for a balanced opening and closing operation. The prior closer linkage has been replaced by a door closer arm that directly couples the door closer and a latching side portion of the door. The door is thus balanced about a central pivot by the door pivot arms connected to the hinge side portion of the door and by the door closer arm connected to the latching side portion of the door.

The balanced door assembly of the present invention includes a door frame having a header, a hinge side jamb, a latching side jamb and a base which together define a doorway. The header has a transversely extending guideway that opens downwardly towards the doorway. The hinge side door jamb has a cavity therein and a hinge shaft is disposed in this cavity. The door has a guide roller mounted along its top between a hinge side portion and a latching side portion of the door, the guide roller projecting into the guideway in the header so that the hinge side portion of the door is swung out of the doorway in one direction and the latching side portion of the door is swung out of the doorway in an opposite direction when the door is pivoted around the guide roller. An upper pivot arm and a lower pivot arm each couple the door and the hinge shaft, the pivot arms each having a pivot end rotatably mounted to the hinge shaft and each having a traveling end rotatably mounted to the door. A door closer is disposed in the header and has a rotatable closer shaft that extends downwardly from a hinge side portion of the header slightly to one side of the midpoint of the header. Means are provided for operatively connecting the closer shaft to the latching side portion of the door to complete the improved arrangement.

The invention further provides a more streamlined door frame by integrating the door roller guideway into the header and positioning it side by side, rather than below a chamber in which the door closer is disposed. The integral guideway eliminates the chance of loose screws that hold the detachable guideway of the prior construction. The door guide roller is barrel-shaped for a one-point rolling contact within the new guideway.

Still another improvement is made by disposing the bearing for the top hinge shaft in a socket formed in the hinge end of the upper door pivot arm, and by forming the upper hinge pin on a bracket that is disposed in a cavity in the hinge side door jamb and fastened below the header, where it is easily accessible for removal. Once the top hinge shaft is removed, the door and pivot arms, which are mounted by the hinge shaft in the hinge side jamb, are also easily disassembled from the door frame.

It is a primary object of the invention to provide effective uniform control of the manually operable door by the door closer throughout a 90° door-operating range.

It is another object of the invention to increase the reliability and serviceability of a balanced door assembly.

It is another object of the invention to provide a streamlined header with an integrally formed roller guideway.

It is another object of the invention to provide a simpler, more reliable linkage between the door closer and the door.

It is another object of the invention to provide for easier assembly and disassembly of the door and the door frame.

It is another object of the invention to reduce friction between the door guide roller and the guideway in the door frame header for smoother operation of the door.

It is another object of the invention to more efficiently utilize the door closer by reversing its position within the header.

It is another object of the invention to provide a guideway in the top of the door with adjustable means for limiting the angle to which the door can be opened.

These and other objects and advantages will be apparent from the description that follows. In the description, reference is made to the accompanying drawings, which are a part hereof, and in which there is shown by way of illustration a preferred embodiment of the invention. This embodiment does not define the full scope of the invention, however, this being reserved for definition by the claims.

DETAILED DESCRIPTION OF THE PREFERRED EMBODIMENT

Figure 1:
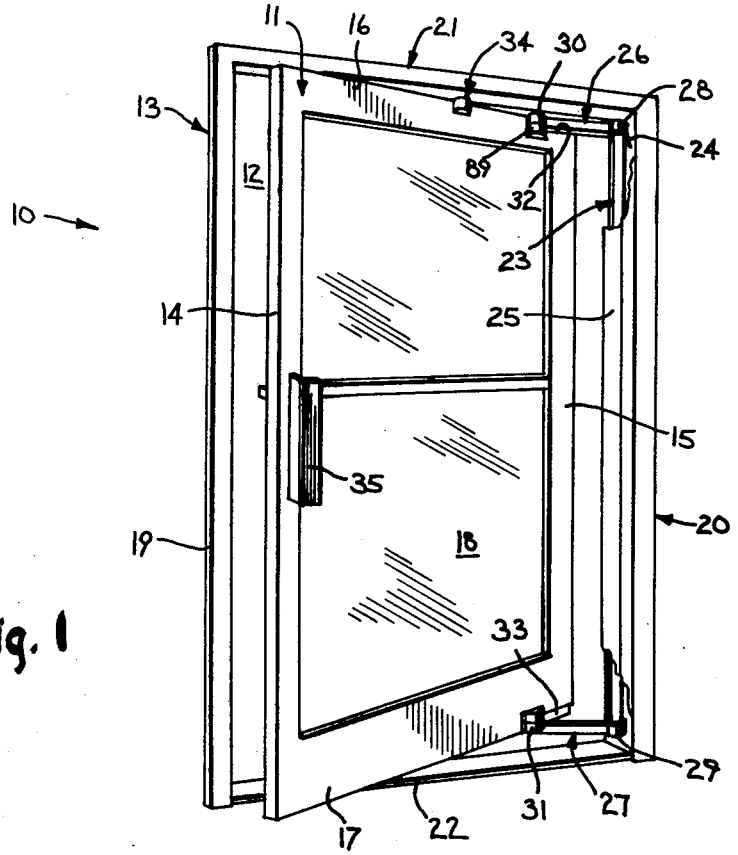
FIG. 1 is a perspective view of a door assembly that incorporates the present invention and includes a door that opens to the left-hand side of the door frame for egress from a building.

Referring to FIG. 1, a door assembly 10 that incorporates the present invention includes a door 11 disposed within a doorway 12 defined by a door frame 13. The door 11 has vertical rails 14 and 15 joined by upper and lower horizontal leafs 16 and 17, respectively, all of these portions of the door 11 being made of metal and adapted to receive the edge portions of a transparent panel 18. The door frame 13 includes side jambs 19 and 20, which are joined by a header 21 across the top of the doorway 12, and which are joined by a base 22 across the bottom of the doorway 12. The rails, leafs, jambs and header are extruded members with interior volumes.

A tubular hinge shaft 23 is provided in a cavity 24 in one side jamb 20 and extends the vertical length of the door 11. The jamb cavity 24 is enclosed along the inside of the doorway 12 by a jamb plate 25, portions of which have been broken away in FIG. 1 to show the hinge shaft 23. A pair of door pivot arms 26 and 27 extend laterally along the topmost and bottommost portions of the door 11, these pivot arms 26 and 27 each having a hub 28 and 29 formed on a hinge end that is mounted to the hinge shaft 23, and each having another hub 30 and 31 formed on a traveling end that is coupled to the door 11. The door 11 includes horizontally extending recesses 32 and 33 along its top and bottom edges to receive the door pivot arms 26 and 27 when the door 11 is closed.

The door 11 of FIG. 1 opens outwardly and to the left-hand side of the doorway 12 from an interior space--within a building, for example. The door 11 pivots around a door guide roller assembly 34 that divides a hinge side, vertical portion of the door 11, which is coupled to the hinge shaft 23 by the door pivot arms 26 and 27, from a latching side, vertical portion of the door 11 having an outside handle 35 mounted on the latching side door rail 14. As the door 11 is opened, the latching side portion swings outwardly from the door frame 13 while the hinge side portion swings inwardly therefrom to provide the balanced movement characteristic of a balance door assembly. The door frame 13 shall also be considered to be divided into latching side and hinge side portions as defined by the closed-door position of the guide roller assembly 34.

A manual balanced door of this general type is disclosed in Catlett et al, U.S. Pat. No. 3,605,339, issued Sept. 20, 1971. As shall be described, the particulars of the door-mounting hardware of the present door assembly 10 vary in several important respects from this prior construction.

Figure 2:
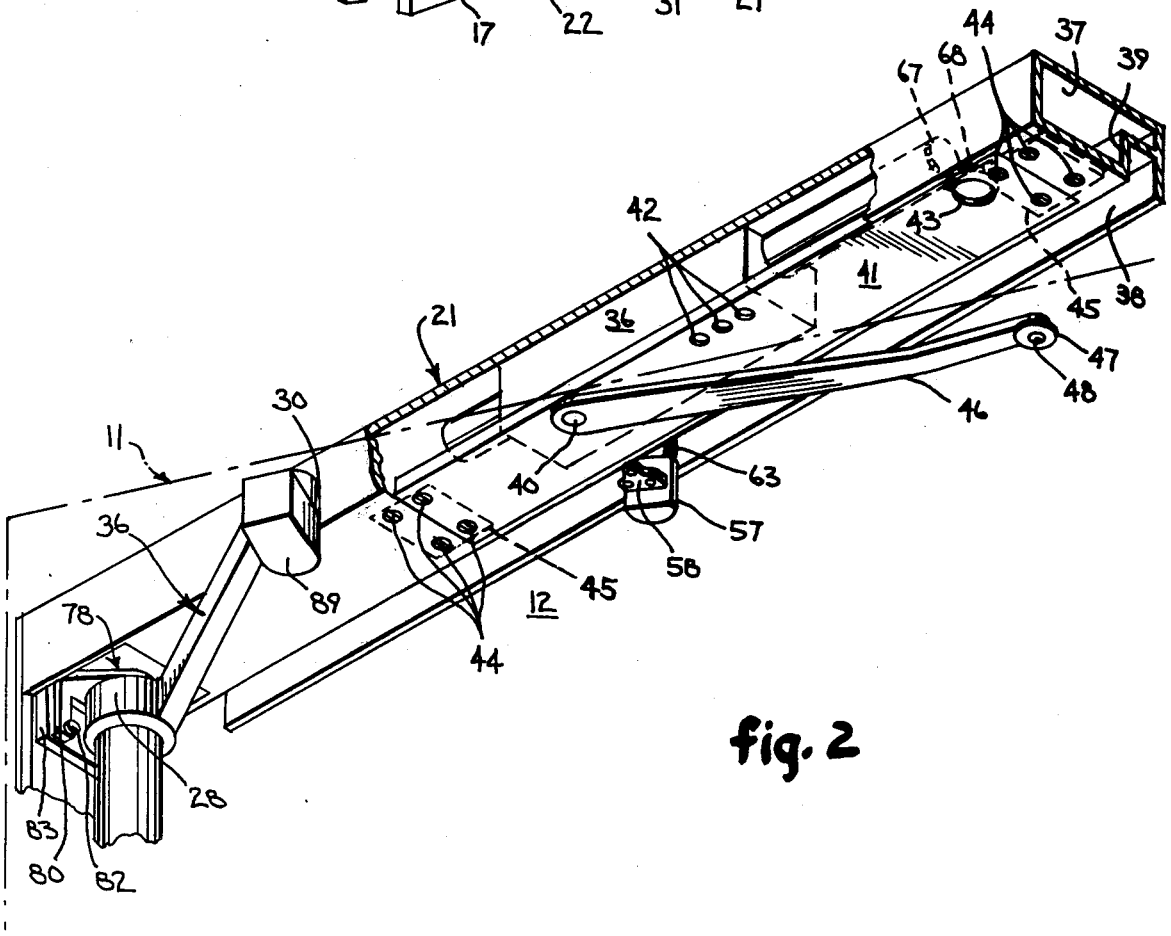
FIG. 2 is a perspective view of the upper left-hand portion of the door frame taken from behind the door assembly of FIG. 1 with parts broken away to show the door hardware of the present invention.
Figure 3:
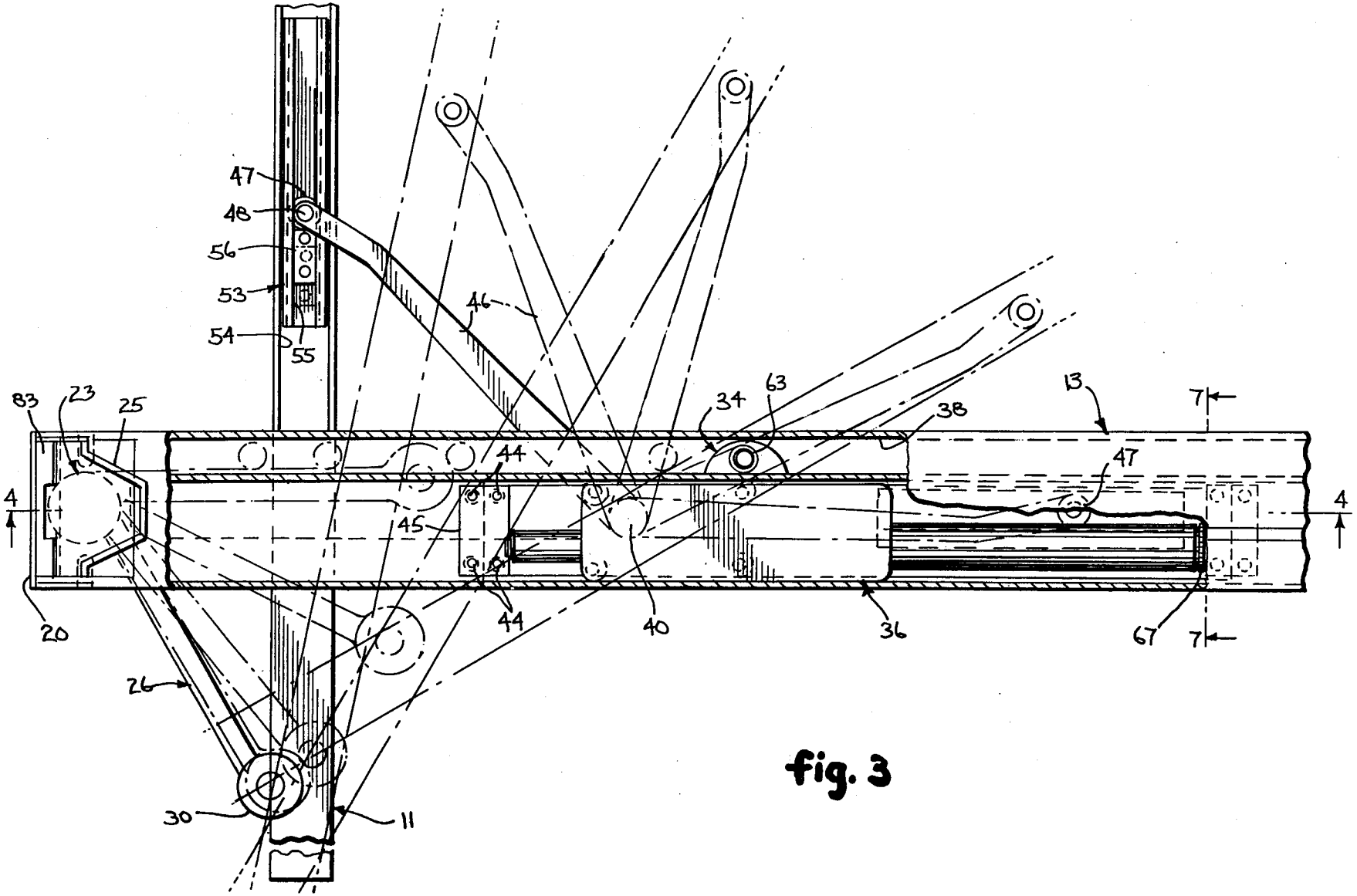
FIG. 3 is a plan view of the door frame assembly of FIG. 1 showing several positions of the door and its associated hardware as the door is operated.
Figure 4:
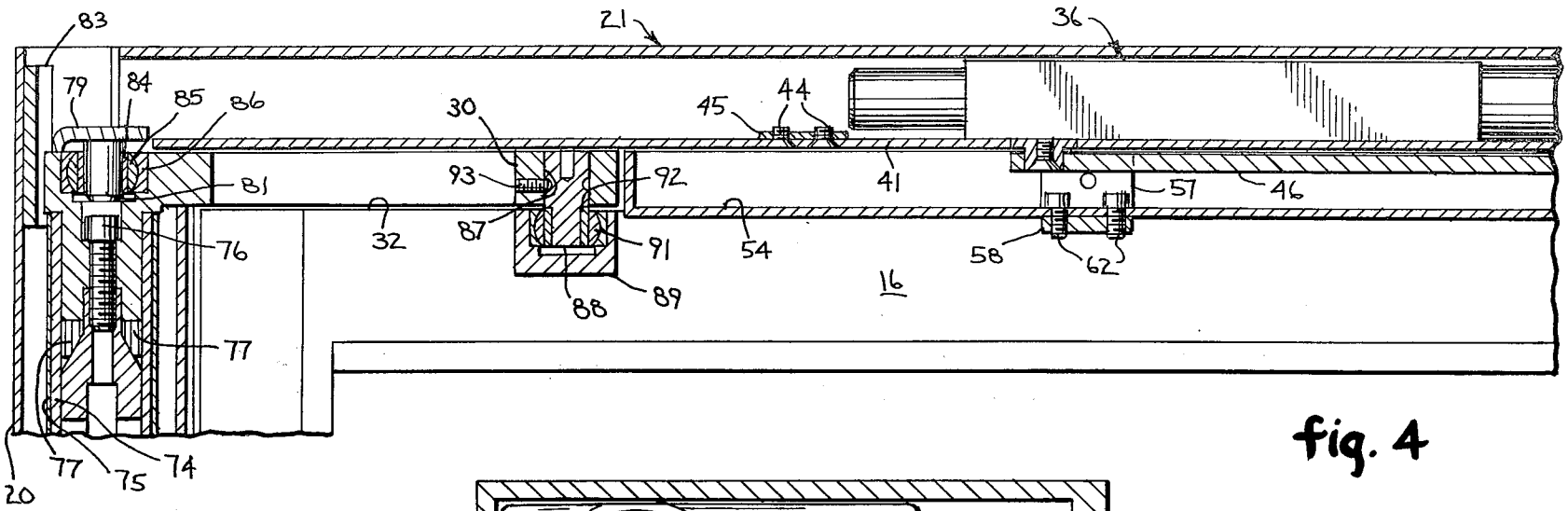
FIG. 4 is a sectional view taken in the plane generally indicated by line 4—4 in FIG. 3.

Referring to FIGS. 2 and 3, a door closer 36 of the type described in the above patent is disposed within a chamber 37 that is formed in a streamlined header 21 of the present invention. The header 21 is extruded so that its interior chamber 37 is disposed side by side with a door roller guideway 38 extending transversely across the top of the doorway 12. The header 21 has a transversely extending rib 39 of L-shaped cross section that separates the interior chamber 37 from the exterior, downwardly opening guideway 38. The door closer 36 has been reversed from its position in the above-mentioned patent, to the position shown in FIG. 3, where its rotatable check shaft 40 depends from the body of the closer 36 a short distance to the hinge side of the door frame 13, as defined by the closed-door position of the guide roller assembly 34. Referring particularly to FIG. 2, the check shaft 40 extends through a door closer tray 41 that covers an access opening in the bottom of the header 21. The door closer tray 41 has three adjustment ports 42 and a relatively larger aperture 43 for access to various adjustments on the door closer 36. As seen in FIGS. 2, 3 and 4, the door closer tray 41 is fastened by screws 44 to mounting plates 45 at opposite ends, and these mounting plates 45 are further fastened by screws 44 to portions of the header 21 adjacent to the opposite ends of the closer tray 41.

Figure 7:
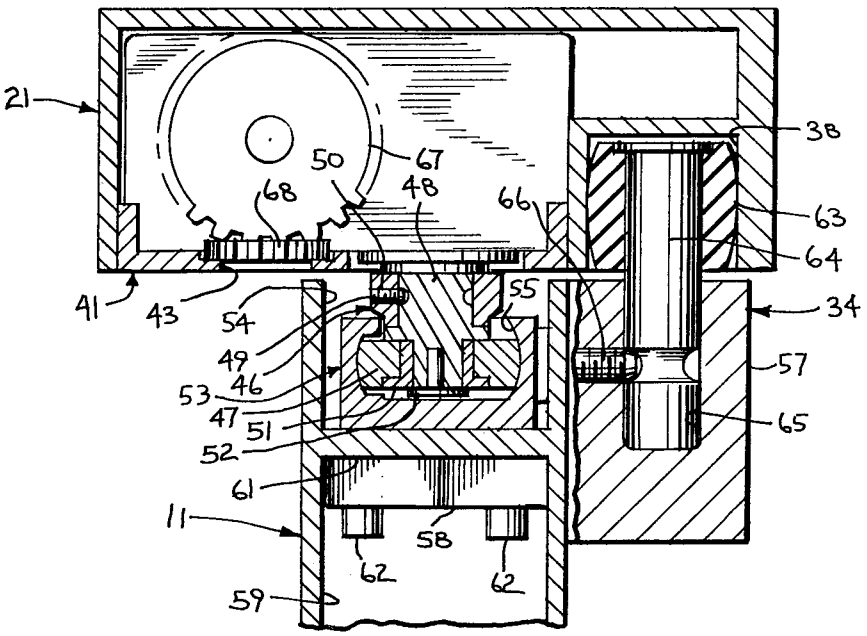
FIG. 7 is a sectional view taken in the plane indicated by line 7—7 in FIG. 3, with parts broken away to show details of the door and door frame at one end of the door closer and inwardly thereof.

Referring again to FIG. 2, a door closer arm 46 has a pivot end mounted on the check shaft 40. The dog-legged door closer arm 46 is formed with a bend to give it added strength. The door closer arm 46 is an integrally formed, rigid member that extends from its pivot end to a traveling end that traces an arc as the door closer arm 46 is pivoted. A closer arm guide roller 47 is mounted on a pivot post 48 depending from the traveling end of the closer arm 46. Further details of this mounting are shown in FIG. 7 where the pivot post 48 is secured to the closer arm 46 by a lockscrew 49 inserted through a laterally extending tap hole 50 in the traveling end of the closer arm 46. The closer arm guide roller 47 encircles a bronze bushing 51, which is held on the pivot post 48 by a flat-headed pin 52 that bears against a lower end flange on the bushing 51. The closer arm guide roller 47 rolls along the concave inner sides of a channel-shaped track member 53, which is disposed in an upwardly opening recess 54 in the top edge of the door 11, the track member 53 having a trough 55 that forms a guideway for the closer arm guide roller 47. As seen in FIG. 3, a stop 56 is fastened at one of several alternative positions within the guideway 55 to limit the movement of the guide roller 47 and thus, to control the angle to which the door 11 can be opened. This angle can be set at ninety degrees, at greater than ninety degrees, or at less than ninety degrees.

Referring again to FIG. 7, the door guide roller assembly 34 includes a mounting block 57 with the flange 58 that extends laterally through the front wall of the door 11 into a hollow portion 59 in the top door leaf extrusion 16. The extending flange 58 is fastened to a web 61 in the upper door leaf extrusion 16 by a plurality of upwardly extending screws 62. The top of the mounting block 57 is level with the top of the door 11, so that the door guide roller 63 is positioned within the door roller guideway 38 in the header 21. The door guide roller 63 is made of a synthetic resinous material and is barrel-shaped to provide a single-point rolling contact along the inside surface of the guideway 38. The door guide roller 63 is held on the mounting block 57 by a guide roller pin 64 that is secured within a pin receiving cavity 65 by a lockscrew 66 inserted laterally through the mounting block 57 into a circumferential groove formed in the pin 64.

Referring now to FIG. 3, it will be observed how the door guide roller 63 moves in one guideway 38 along the hinge side of the header 21, while the guide roller 47 on the traveling end of the door closer arm 46 moves inwardly and away from the latching rail 14 of the door 11 until impeded by the stop 56 in the other guideway 55. It will also be noticed how a door pivot axis provided by the pivot shaft 48 for the closer arm guide roller 47 moves to the outer or front side of the door frame 13 as a pivot axis defined by the vertically aligned hubs 30 and 31 on the traveling ends of the door pivot arms 26 and 27 moves to the inner or back side of the door frame 13 to provide balanced door movement. This counter-balanced operation of the door pivot arms 26 and 27 with the door closer arm 46 is achieved when the door guide roller assembly 34 is attached to the door at a location approximately twice the length of the door pivot arms 26 and 27 from the hinge shaft 23, and when the closer check shaft 40 is positioned between the door guide roller assembly 34 and the hubs 30 and 31 of the pivot arms 26 and 27 when the door is closed. The position and shape of the two guide rollers 47 and 63 provides for a smooth opening and closing operation for the door 11.

Referring again to FIG. 2, "opening speed," "initial closing speed," and "latching speed" are controlled by the hydraulic adjusters (not shown) accessible through the adjustment ports 42. Where strong wind forces might be encountered it may be desired to adjust the tension of a spring (not shown) within the closer 36. Spring tension is controlled by a gear 67 on the end of the door closer 36 that extends into the latching side of the door frame 13 and is seen best in FIG. 7. A slotted tension adjustment gear 68 engages this door closer gear 67 at a right angle and is adjusted with a screwdriver inserted through the aperture 43.

Figure 5:
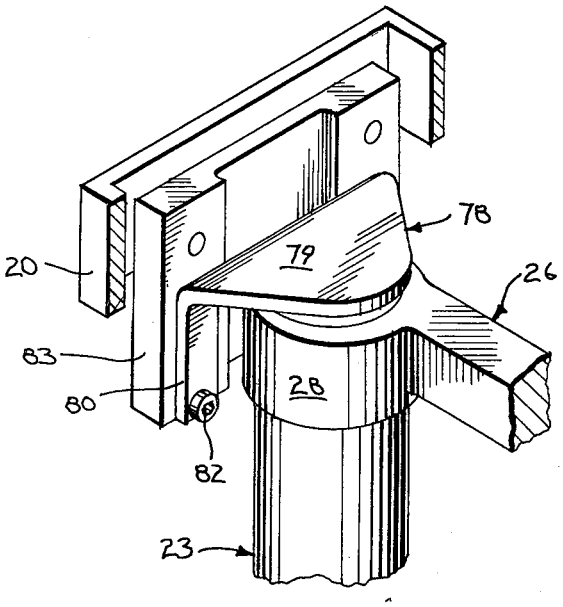
FIG. 5 is a perspective view of the door hardware mounted in the upper left-hand corner of the door frame in FIG. 2.
Figure 6:
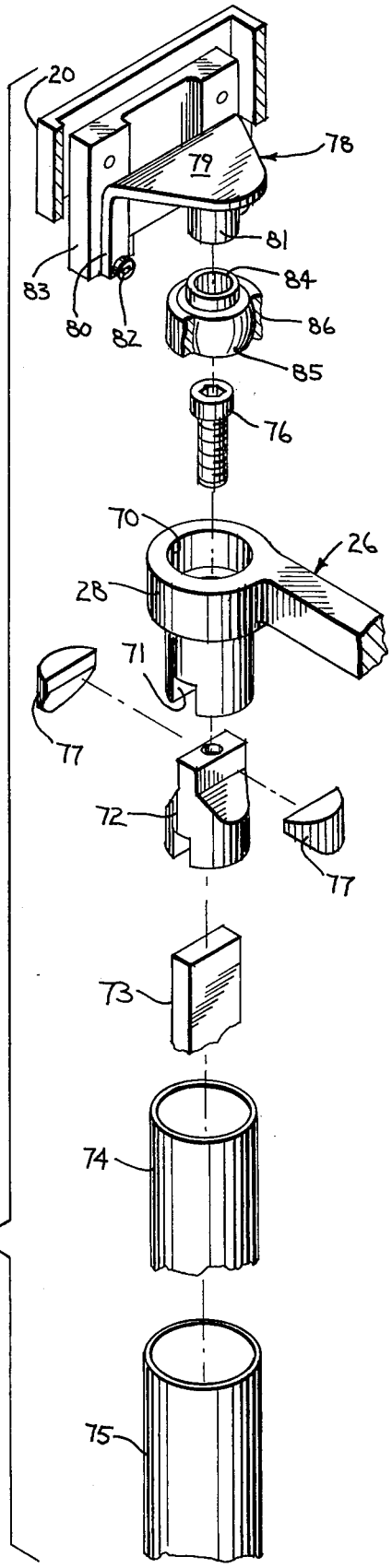
FIG. 6 is an exploded view of the door hardware of FIG. 5.

Besides improving the operation of the balanced door, the present invention makes it easier to install the door 11 in the door frame 13 and makes it easier to remove the door 11 for periodic inspection and any necessary maintenance. Referring to FIGS. 2, 4, 5 and 6, the manner of mounting the hinge end of the upper door pivot arm 26 on the hinge shaft 23 will now be described. First, as seen in FIG. 6, the hub 28 on the hinge end of the upper door pivot arm 26 is formed with an upwardly opening socket 70, and a downwardly extending slot 71 for accepting the upper end of an upper hinge tube insert 72. This insert 72 is supported on a hinge reinforcing beam 73 that fits within an inner metal tube 74, that is sheathed by an outer vinyl tube 75 to form the hinge shaft 23. A socket head cap screw 76 is inserted downwardly through the socket 70 of the upper door pivot arm 26 and into the insert 72, as seen in FIG. 4, to sandwich a pair of wedges 77 therebetween and provide a snug connection within the inner hinge tube 74.

In the prior construction, a hinge pin extended upwardly from the hub end of the upper door pivot arm. This was necessary due to the coupling of this pin to the door closer linkage. As seen in FIGS. 5 and 6 of this embodiment, however, an upper pivot bracket 78 has a triangular horizontal plate 79, a pair of legs 80 extending downwardly from two back corners of this plate, and a pivot pin 81 extending downwardly from the middle of this plate. The legs of the upper pivot bracket 78 are attached by screws 82 to an upper pivot mounting plate 83, which in turn is attached to an inside wall of the hinge side door jamb 20. As seen in FIG. 2, the legs of the upper pivot bracket are mounted at a level below the streamlined header 21 so that the screws 82 are easily accessible when the hinge side jamb plate 25 in FIG. 1 is removed. Referring again to FIG. 6, the pivot pin 81 is disposed within the socket 70 in the hub 28 of the upper pivot arm 26 and is encircled by a bearing assembly. A needle bearing 84 encircles the pivot pin 81, and is itself encircled by a self-aligning ball-type bearing 85, from which it is slightly withdrawn for a better view in FIG. 6. The ball-type bearing 85 is received in a race 86 that fits within the socket 70. The combination of bearings assures proper alignment of the hinge axis and the smooth operation of the balanced door assembly 10.

As seen in FIG. 4, the traveling end of the upper door pivot arm 26 has a downwardly opening socket 87 in which a pivot shaft 88 is disposed, the pivot shaft 88 projecting downwardly into a top door pivot housing 89 that holds a race 90, a ball-type self-aligning bearing 91 within the race, and a needle bearing 92 that immediately encircles the pivot shaft 88. The pivot shaft 88 is formed with a circumferential groove and is secured to the pivot arm 26 by a set screw inserted laterally through the hub 30 into the groove.

Referring again to FIG. 1, the hub 29 on a hinge end of the lower pivot arm 27 is mounted on an upwardly extending pivot pin with a special bearing arrangement, this pivot pin and bearing arrangement being substantially as described in U.S. Pat. No. 3,605,339 cited above. It can be seen from the description above, and particularly FIGS. 1 and 2, that by removing the hinge jamb plate 25 and the screws 82 mounting the upper pivot bracket 78, the hinge shift 23 can be lifted off the bottom pivot pin, thereby allowing the door 11 to be easily removed from the door frame 13. Thus, the new style and arrangement of door hardware components provides advantages in the installation and maintenance of a balanced door assembly in addition to improved operating characteristics and greater reliability.

We claim:

1. A balanced door assembly comprising:

a door frame having a base, a hinge side jamb, a latching side jamb, and a header that define a doorway, the header including a chamber and a guideway which extend transversely above the doorway and which are separated by a transversely extending rib formed by the header, the guideway opening downwardly towards the doorway;

a hinge shaft disposed within the hinge side jamb;

a door with an upper leaf in which a guideway is formed to open upwardly towards the header;

an upper and a lower door pivot arm each having a hinge end pivotably mounted to the hinge shaft and each having a traveling end on which the door is pivotably mounted, the traveling ends being vertically aligned to define a first axis of a door rotation;

a door closer disposed within the header chamber and having an pivotable shaft extending downwardly from the header;

a closer arm having a pivot end mounted on the closer shaft and having a traveling end that swings around its pivot end;

a guide roller mounted to the upper leaf of the door and projecting into the guideway in the header to provide a second axis of door rotation, the second axis being retained within the door frame as the door is pivotably opened and closed;

pivot means mounted on the traveling end of the closer arm and received in the door guideway for providing a third axis of door rotation; and wherein, the first and third axes of door rotation are displaced from the doorway in opposite directions as the door is opened.

2. The door assembly of claim 1, wherein:

the hinge side door jamb has a substantially vertical cavity therethrough;

wherein the hinge shaft is disposed in the cavity of the hinge side door jamb;

wherein the upper door pivot arm is mounted on top of the hinge shaft and has a socket opening upwardly therefrom;

further comprising a pivot pin removably supported within the cavity of the hinge side door jamb and removably supported within the header for pivotably mounting the upper door pivot arm on the upper end of the hinge shaft; and further comprising a bearing assembly disposed within the socket of upper pivot arm and encircling the pivot pin.

3. The balanced door assembly of claim 2, wherein the bearing assembly includes a needle bearing encircling the pivot pin and a ball-type, self-aligning bearing encircling the needle bearing.

4. The balanced door assembly of claim 1, wherein the door closer is elongated with a spring adjustment at one end and with a pivotable shaft near its opposite end, and is disposed within the header with its pivotable shaft towards the hinge side of the doorway and with its spring adjustment towards the latching side of the doorway.

5. The door assembly of claim 4, wherein:

the header includes a downwardly opening aperture aligned with the spring adjustment on the door closer; and further comprising a tension adjustment gear engaging the spring adjustment for the door closer and aligned with the aperture to be adjusted therethrough.

6. The balanced door assembly of claim 1, wherein the guide roller is barrel-shaped.

7. The balanced door assembly of claim 1, wherein the door guideway includes a channel-shaped closer track assembly for receiving the pivot means, the closer track assembly defining a trough and having a stop disposed within the trough at a preselected one of a plurality of positions to limit the travel of the closer arm and the resultant angle to which the door can be opened.

8. The balanced door assembly of claim 1, wherein the door closer arm is an integrally formed member.

9. A balanced door assembly comprising:

a door frame having a header, a hinge side jamb, a latching side jamb and a base which together define a doorway, the header having a transversely extending guideway that opens downwardly towards the doorway, and the hinge side jamb having a cavity therein;

a hinge shaft disposed in the cavity in the hinge side jamb;

a door and a guide roller mounted along the top of the door, the guide roller dividing and defining a hinge side portion and a latching side portion of the door and door frame when the door is closed, the guide roller projecting into the guideway in the header so that the hinge side portion of the door is swung out of the doorway in one direction and the latching side portion of the door is swung out of the doorway in an opposite direction when the door is pivoted around the guide roller;

an upper pivot arm and a lower pivot arm each coupling the door and the hinge shaft, the pivot arms each having a pivot end rotatably mounted to the hinge shaft and each having a traveling end rotatably mounted to the door;

a door closer disposed in the header and having a rotatable closer shaft that extends downwardly from a hinge side portion of the header; and a door closer arm having a pivot end mounted on the closer shaft on a hinge side portion of the header and having a traveling end pivotally connected to the latching side portion of the door.

10. The balanced door assembly of claim 9 wherein:

the upper door pivot arm is mounted on top of the hinge shaft and has a socket opening upwardly towards the header;

further comprising a pivot pin removably supported in the cavity of the hinge side jamb and removably supported below the header for pivotably mounting the upper pivot arm and the upper end of the hinge shaft; and further comprising a bearing assembly disposed within the socket of the upper pivot arm and encircling the pivot pin.

11. The balanced door assembly of claim 9, wherein the door closer is disposed in the header in juxtaposition with the transversely extending guideway that receives the door guide roller.

* * * * *

UNITED STATES PATENT AND TRADEMARK OFFICE

CERTIFICATE OF CORRECTION

PATENT NO. : 4,286,411

DATED : September 1, 1981

INVENTOR(S) : Lee Wikkerink, James R. Schinschke

It is certified that error appears in the above—identified patent and that said Letters Patent is hereby corrected as shown below:

olumn 1, line 15 - "3,605,399" should be --3,605,339--.

Signed and Sealed this

*Third* Day of *November 1981*

[SEAL]

*Attest:*

GERALD J. MOSSINGHOFF

*Attesting Officer*

*Commissioner of Patents and Trademarks*